US008882398B2

(12) United States Patent
Bender et al.

(10) Patent No.: US 8,882,398 B2
(45) Date of Patent: Nov. 11, 2014

(54) RETAINING WALL BLOCK AND SYSTEM

(71) Applicant: Brampton Brick Limited, Brampton (CA)

(72) Inventors: Elliot Claydon Bender, Kitchener (CA); Guy Bradley Keys, Guelph (CA)

(73) Assignee: Brampton Brick Limited, Brampton, Ontario (CA)

( * ) Notice: Subject to any disclaimer, the term of this patent is extended or adjusted under 35 U.S.C. 154(b) by 0 days.

(21) Appl. No.: 13/926,203

(22) Filed: Jun. 25, 2013

(65) Prior Publication Data

US 2013/0343824 A1 Dec. 26, 2013

(30) Foreign Application Priority Data

Jun. 26, 2012 (CA) ..... 2782659

(51) Int. Cl.
*E02D 29/02* (2006.01)
*E04C 1/00* (2006.01)

(52) U.S. Cl.
CPC ..... *E02D 29/025* (2013.01)
USPC ..... 405/286; 405/284

(58) Field of Classification Search
USPC ..... 405/284, 286
See application file for complete search history.

(56) References Cited

U.S. PATENT DOCUMENTS

| | | | | |
|---|---|---|---|---|
| D370,272 | S | 5/1996 | Risi et al. | |
| 5,622,456 | A | 4/1997 | Risi et al. | |
| 5,816,749 | A | 10/1998 | Bailey, II | |
| 6,152,655 | A | 11/2000 | Hull | |
| 6,178,715 | B1 | 1/2001 | Pacitto et al. | |
| D464,149 | S | 10/2002 | Risi et al. | |
| D512,162 | S | 11/2005 | Risi | |
| D516,734 | S | 3/2006 | Keys et al. | |
| 7,048,250 | B2 * | 5/2006 | Mothes | 249/52 |
| 7,871,223 | B2 | 1/2011 | MacDonald et al. | |
| 2007/0166112 | A1 | 7/2007 | Risi | |
| 2008/0190057 | A1 | 8/2008 | MacDonald et al. | |
| 2009/0245943 | A1 * | 10/2009 | Blundell | 405/286 |
| 2011/0078978 | A1 | 4/2011 | Wauhop | |
| 2011/0162314 | A1 | 7/2011 | Leach et al. | |

FOREIGN PATENT DOCUMENTS

| | | |
|---|---|---|
| CA | 941626 | 2/1974 |
| CA | D51160 | 4/1983 |
| CA | D51313 | 5/1983 |
| CA | D51904 | 10/1983 |
| CA | 1182295 A | 2/1985 |
| CA | 1204296 A | 5/1986 |
| CA | 1210249 A | 8/1986 |
| CA | D57926 | 1/1987 |
| CA | D58080 | 2/1987 |
| CA | D58391 | 3/1987 |
| CA | D64161 | 9/1989 |
| CA | D64209 | 9/1989 |

(Continued)

*Primary Examiner* — Benjamin Fiorello
(74) *Attorney, Agent, or Firm* — Bereskin & Parr LLP/S.E.N.C.R.L.,s.r.l.

(57) ABSTRACT

A retaining wall block, a retaining wall system, and method of constructing a retaining wall are provided. The retaining wall block has a pair of top projections, a top groove, a pair of bottom grooves and a bottom protrusion to connect one retaining wall block to another. The block is connectable to another block in one of a first position where front faces of the block and the other block are aligned, and a second position where the front faces of the block and the other block are offset.

20 Claims, 17 Drawing Sheets

(56) References Cited

FOREIGN PATENT DOCUMENTS

| | | | |
|---|---|---|---|
| CA | D64210 | | 9/1989 |
| CA | D64669 | | 10/1989 |
| CA | 2017578 | C | 11/1991 |
| CA | D70967 | | 7/1992 |
| CA | D71331 | | 8/1992 |
| CA | 1307675 | C | 9/1992 |
| CA | 2045953 | C | 12/1992 |
| CA | 2075580 | A1 | 2/1994 |
| CA | D78184 | | 4/1996 |
| CA | 2145344 | C | 9/1996 |
| CA | D83773 | | 5/1998 |
| CA | D85102 | | 11/1998 |
| CA | D84133 | | 12/1998 |
| CA | D85643 | | 1/1999 |
| CA | D86787 | | 5/1999 |
| CA | D86817 | | 5/1999 |
| CA | 2327780 | A1 | 6/2001 |
| CA | D98211 | | 2/2003 |
| CA | D98212 | | 2/2003 |
| CA | D98213 | | 2/2003 |
| CA | D98214 | | 2/2003 |
| CA | 2469128 | C | 11/2004 |
| CA | 2438565 | A1 | 2/2005 |
| CA | D104577 | | 2/2005 |
| CA | D95778 | | 3/2005 |
| CA | D95276 | | 7/2005 |
| CA | D107149 | | 11/2005 |
| CA | D108046 | | 1/2006 |
| CA | D108047 | | 2/2006 |
| CA | D108048 | | 2/2006 |
| CA | 2531950 | C | 7/2007 |
| CA | 2547415 | A1 | 11/2007 |
| CA | 2628359 | A1 | 10/2009 |
| CA | D137197 | | 4/2011 |
| WO | 91/19057 | A1 | 12/1991 |
| WO | 93/00484 | A1 | 1/1993 |
| WO | 02/42588 | A1 | 5/2002 |
| WO | 2010040225 | A1 | 4/2010 |

* cited by examiner

RETAINING WALL BLOCK AND SYSTEM

RELATED APPLICATION

This application claims priority to Canadian Patent Application Serial No. 2,782,659, filed Jun. 26, 2012, the entire contents of which are hereby incorporated by reference.

FIELD

The invention relates generally to a retaining wall block and system, and a method for constructing a retaining wall.

BACKGROUND OF THE INVENTION

Retaining walls are structures that typically hold back earth material. They typically resist the lateral forces exerted by earth material, such as soil. In some cases, retaining walls are used to stabilize earth material that has a sloping surface. Retaining walls are also used to retain earth material at a different elevation than an adjacent ground surface, for aesthetic or structural purposes.

Many retaining walls are constructed by vertically stacking a plurality of retaining wall blocks. U.S. Pat. No. 5,816,749 to Bailey, II discloses a modular wall block. The modular wall block has a pair transverse projections extending upwardly from its top surface, spaced from each other by an upwardly opening groove. The modular wall block also has a pair of downwardly opening, transverse grooves spaced from each other by a downwardly extending projection. When one modular wall block is stacked onto another, the downwardly extending projection of the higher block may be received in the upwardly opening groove of the lower block to offset the front faces of the two blocks. In another stacked configuration, the pair of upwardly extending projections of the lower block are received within one of the pair of downwardly opening, transverse grooves of the higher block, to align the front faces of the two blocks.

SUMMARY

The summary is provided to introduce the reader to the more detailed discussion to follow. The summary is not intended to limit or define the claims.

According to one aspect, a retaining wall block connectable to another retaining wall block is disclosed. The retaining wall block comprises a front face, a top surface and a bottom surface. The retaining wall block also comprises a pair of sidewalls extending rearwardly from the front face, between the top and bottom surfaces. The block has a pair of elongate spaced apart bottom grooves in the bottom surface. The pair of bottom grooves are oriented transversely to the pair of sidewalls. The pair of bottom grooves define an elongate bottom protrusion therebetween. The block has a pair of elongate spaced apart top projections in the top surface. The pair of top projections are oriented transversely to the pair of sidewalls. The pair of top projections define an elongate groove extending therebetween. The block is connectable to the other block in one of a first position where the front faces of the block and the other block are aligned, and a second position where the front faces of the block and the other block are offset. In the first position, the bottom protrusion of the block is received within the top groove of the other block. In the second position, the pair of top projections of the other block are received within one of the pair of bottom grooves of the block.

In some embodiments, in the first position, each one of the pair of top projections of the other block is received within a corresponding different one of the pair of bottom grooves of the block.

In some embodiments, in the second position, each one of the pair of top projections of the other block is located proximate to a corresponding side edge of one of the pair of bottom grooves of the block.

In some embodiments, the block is connectable to the other block in a third position where the front faces of the block and the other block are offset in a different orientation. In the third position, the pair of top projections of the block are received within the other one of the pair of bottom grooves of the other block.

The block and the other block may be substantially identical.

Each end of the pair of top projections may be located inwardly from the sidewalls. Each pair of bottom grooves may extend entirely along the bottom surface between the sidewalls.

The top groove may have a pair of side edges. The pair of side edges of the top groove may taper upwardly away from one another. The bottom protrusion may have a pair of side edges. The pair of side edges of the bottom protrusion may taper downwardly toward one another.

The pair of top projections may comprise a pair of outer side edges. The outer side edges of the pair of top projections may taper upwardly toward one another. In some embodiments, at least one of the pair of bottom grooves has a pair of side edges that taper downwardly away from one another.

The pair of top projections may extend in parallel orientation to one another along the top surface of the block. The pair of bottom grooves may extend in parallel orientation to one another along the bottom surface of the block.

Each one of the pair of bottom grooves may have a pair of opposing side edges and a groove width extending between the side edges. The pair of bottom grooves may have substantially equal groove widths.

In some embodiments, the block further comprises a second pair of elongate spaced apart top projections extending along the top surface. Each top projection of the pair of top projections is longitudinally aligned with a corresponding top projection of the second pair of top projections.

According to another aspect, a retaining wall system comprising at least a first block and a second block is disclosed. The first block and the second block each comprise a front face, a top surface and a bottom surface. The first block and the second block also each comprise a pair of sidewalls extending rearwardly from the front face, between the top and the bottom surfaces. At least the first block has a pair of elongate spaced apart bottom grooves in the bottom surface. The pair of bottom grooves are oriented transversely to the pair of sidewalls. The pair of bottom grooves define an elongate bottom protrusion therebetween. At least the second block has a pair of elongate spaced apart top projections in the top surface. The pair of top projections are oriented transversely to the pair of sidewalls. The pair of top projections define an elongate top groove extending therebetween. The first and second block are connectable in one of a first position where the front faces of the first and second block are aligned, and a second position where the front faces of the first and second block are offset. In the first position, the bottom protrusion of the first block is received within the top groove of the second block. In the second position, the pair of top projections of the second block are received within one of the pair of bottom grooves of the first block.

In some embodiments, in the first position, each one of the pair of top projections of the second block is received within a corresponding different one of the pair of bottom grooves of the first block.

In some embodiments, in the second position, each one of the pair of top projections of the second block is located proximate to a corresponding side edge of one of the pair of bottom grooves of the first block.

In some embodiments, the second block is connectable to the first block in a third position where the front faces of the first block and the second block are offset in a different orientation. In the third position, the pair of top projections of the second block are received within the other one of the pair of bottom grooves of the first block.

The first block may have the pair of elongate spaced apart top projections in the top surface.

The top surface of the first block may be substantially planar.

The second block may have the pair of elongate spaced apart bottom grooves in the bottom surface.

According to yet another aspect, a method of constructing a retaining wall is disclosed. The method comprises connectably stacking a first block with a second block in one of a first position where the front faces of the first and second block are aligned, and a second position where the front faces of the first and second block are offset. The first block and the second block each comprise a front face, a top surface and a bottom surface. The first block and the second block also each comprise a pair of sidewalls extending rearwardly from the front face, between the top and bottom surfaces. At least the first block has a pair of elongate spaced apart bottom grooves in the bottom surface. The pair of bottom grooves are oriented transversely to the pair of sidewalls. The pair of bottom grooves define an elongate bottom protrusion therebetween. At least the second block has a pair of elongate spaced apart top projections in the top surface. The pair of top projections are oriented transversely to the pair of sidewalls. The pair of top projections define an elongate top groove extending therebetween. In the first position, the bottom protrusion of the first block is received within the top groove of the second block. In the second position, the pair of top projections of the second block are received within one of the pair of bottom grooves of the first block.

DRAWINGS

Reference is made in the description of various embodiments to the accompanying drawings, in which.

DESCRIPTION OF VARIOUS EMBODIMENTS

Retaining walls are commonly formed by vertically stacking wall blocks. For such systems, one side of the retaining wall typically holds back earth material, such as soil, while the opposing side of the wall remains visible. It is often a matter of aesthetic preference as to whether the visible front faces of each block vertically align with the front faces of the other blocks. In some cases, it might be desirable to have a visible front face that appears entirely planar (i.e. the front faces of the blocks are vertically aligned with one another). In other circumstances, it might be desirable to stack the blocks so that their faces are vertically offset from one another, to give a staggered or "stepped" look. It may also be desirable to align some blocks' front faces, and offset others.

One configuration may also be more appropriate for supporting higher lateral loads than other configurations. In turn, the desired configuration may change in accordance with different design loads.

Exemplary retaining wall blocks are described herein. These modular blocks can be stacked to provide aligned or offset front block faces, as the user desires. Exemplary retaining wall systems and a method of constructing a retaining wall are also described.

FIGS. 1 to 6 illustrate different views of an exemplary retaining wall block 10. Block 10 is connectable to at least one other retaining wall block to form a retaining wall system, as will be discussed later in more detail.

Figure 1:
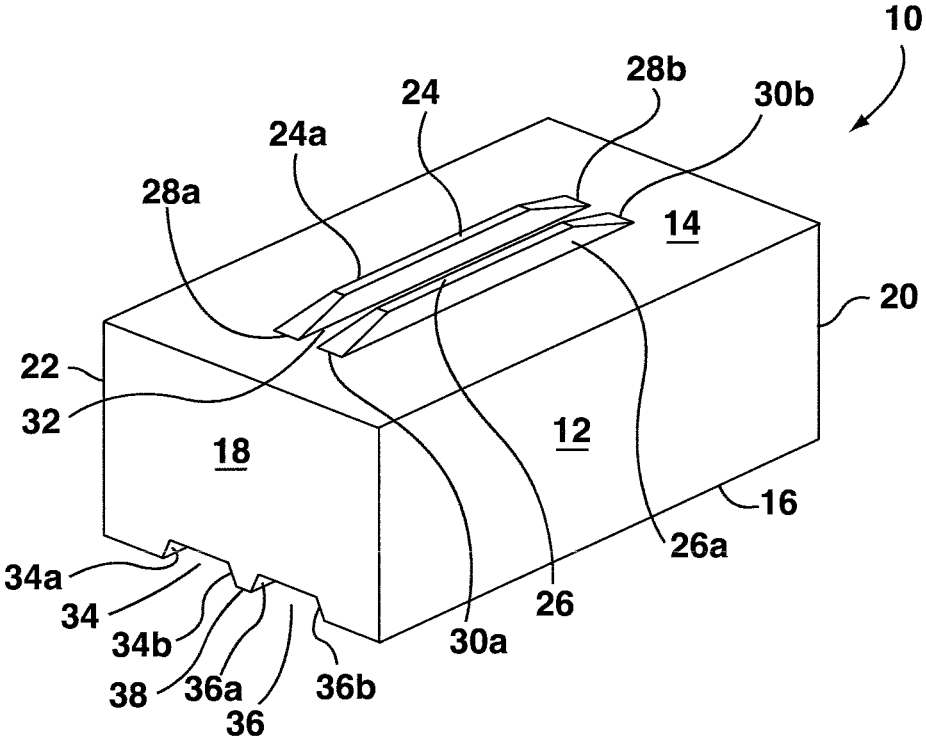
FIG. 1 is a top perspective view of an exemplary retaining wall block.

Referring to FIG. 1, block 10 has a front face 12, a top surface 14, a bottom surface 16 and a pair of sidewalls 18 and 20. Block 10 may also have a rear face 22 that opposes front face 12. As shown in FIG. 1, front face 12 may be a smooth, planar surface. In some cases, front face 12 may be a roughened surface (not shown), to provide an aesthetic finish to front face 12.

Continuing to refer to FIG. 1, block 10 has a pair of elongate spaced apart top projections 24, 26 in top surface 14. Top projections 24, 26 are oriented transversely to the pair of sidewalls 18, 20. Top projections 24, 26 may extend in parallel orientation to one another along top surface 14. As shown in FIG. 1, top projection 24 has ends 28*a* and 28*b*, and top projection 26 has ends 30*a* and 30*b*. Ends 28*a*, 28*b* and ends 30*a*, 30*b* may be located inwardly (i.e. inwardly spaced) from each of the sidewalls 18 and 20, resulting in top projections 24, 26 not spanning the entire length of the top surface 14. In some embodiments, the distance along top surface 14 between one set of adjacent ends 28*a*, 30*a* and one of the sidewalls 18 is different than the distance along top surface 14 between the other set of adjacent ends 28*b*, 30*b* and the other sidewall 20.

Figure 2:
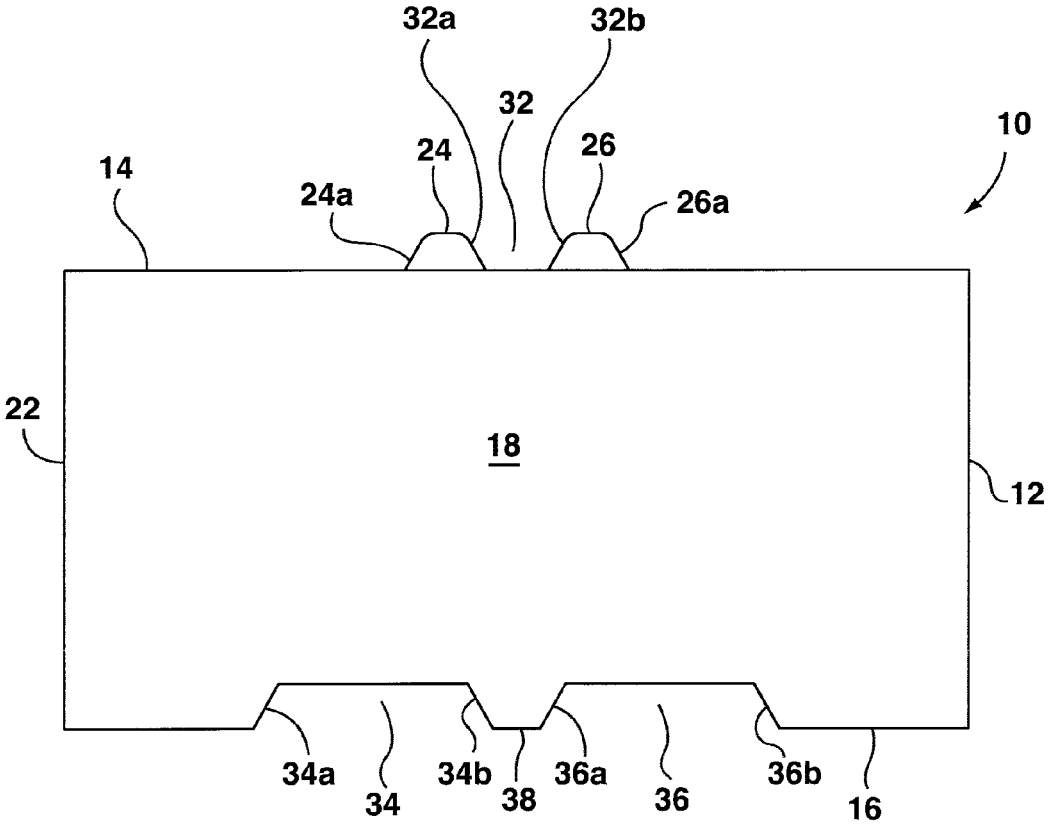
FIG. 2 is a side view of the block of FIG. 1.

As most clearly shown in FIG. 2, the pair of top projections 24, 26 comprise a pair of outer side edges 24*a*, 26*a*, respectively. The outer side edges 24*a*, 26*a* of the pair of top projections 24, 26 may taper upwardly toward one another.

As shown most clearly in FIG. 2, top projections 24 and 26 define an elongate top groove 32 extending therebetween. The top groove has a pair of side edges 32*a* and 32*b*. The pair of side edges 32*a*, 32*b* of top groove 32 may taper upwardly away from one another.

Figure 3:
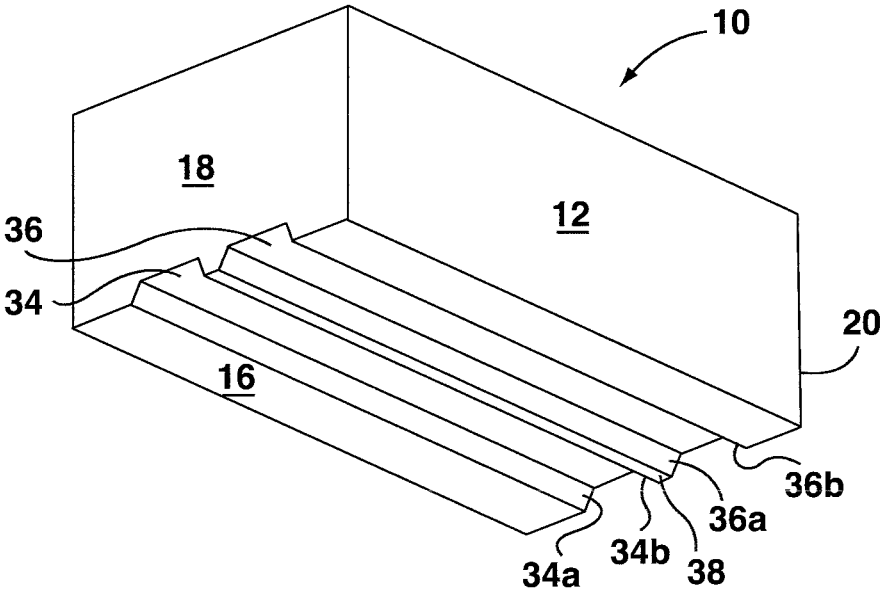
FIG. 3 is a bottom perspective view of the block of FIG. 1.

Referring now to FIG. 3, a pair of elongate spaced apart bottom grooves 34, 36 are provided in bottom surface 16. Bottom grooves 34, 36 are oriented transversely to the pair of sidewalls 18, 20 of block 10. Bottom grooves 34, 36 may extend in parallel orientation to one another along bottom surface 16. Bottom grooves 34, 36 preferably extend entirely along bottom surface 16 between each of the sidewalls 18 and 20.

As most clearly shown in FIG. 2, bottom groove 34 has a pair of side edges 34*a*, 34*b*, and bottom groove 36 has a pair of side edges 36*a*, 36*b*. In one embodiment, at least one of bottom groove 34 and bottom groove 36 has a pair of side edges that taper downwardly away from one another. In other words, side edges 34*a* and 34*b* may taper downwardly away from one another and/or side edges 36*a* and 36*b* may taper downwardly away from one another.

Referring to FIGS. 2 and 3, the pair of bottom grooves 34, 36 define an elongate bottom protrusion 38 extending therebetween. Bottom protrusion 38 has a pair of side edges 34*b*, 34*a*. The pair of side edges of bottom protrusion 38 are side edges 34*b* and 36*a* of bottom grooves 34 and 36, respectively. As most clearly shown in FIG. 2, the pair of side edges 34*b* and 36*a* may taper downwardly toward one another.

Figure 4:
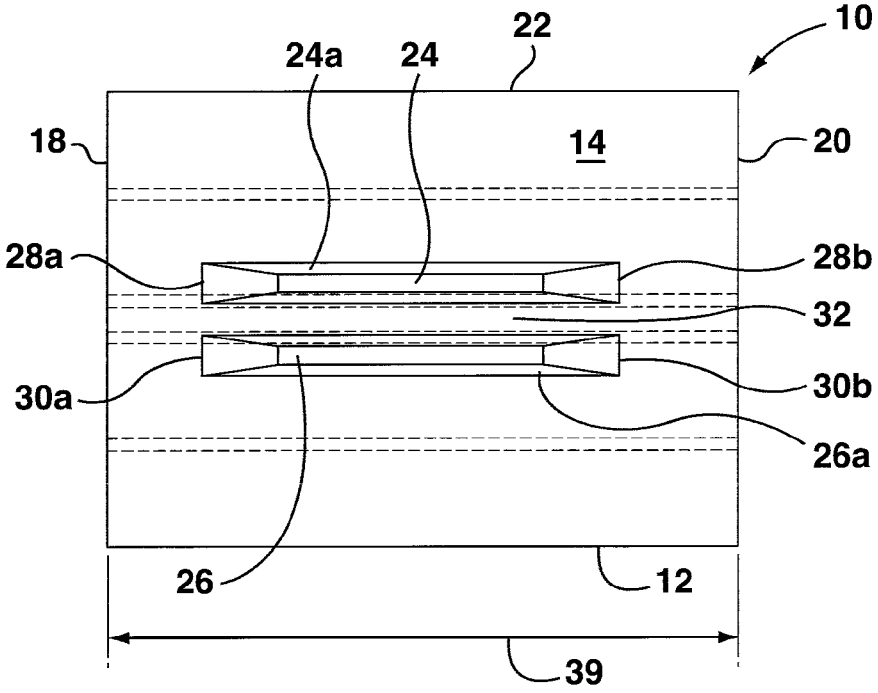
FIG. 4 is a top view of the block of FIG. 1.
Figure 5:
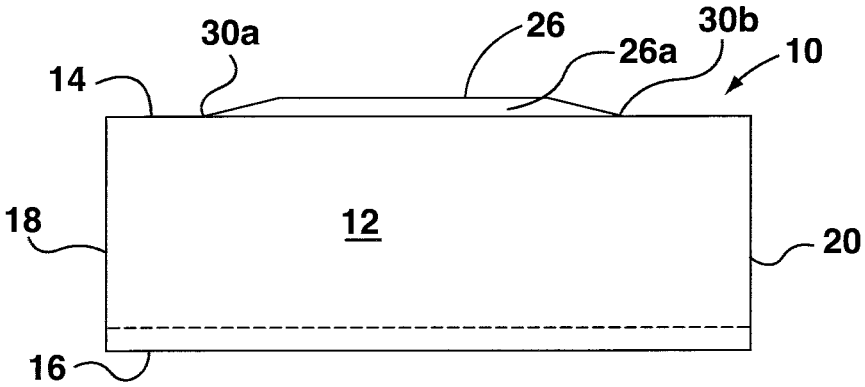
FIG. 5 is a front view of the block of FIG. 1.
Figure 6:
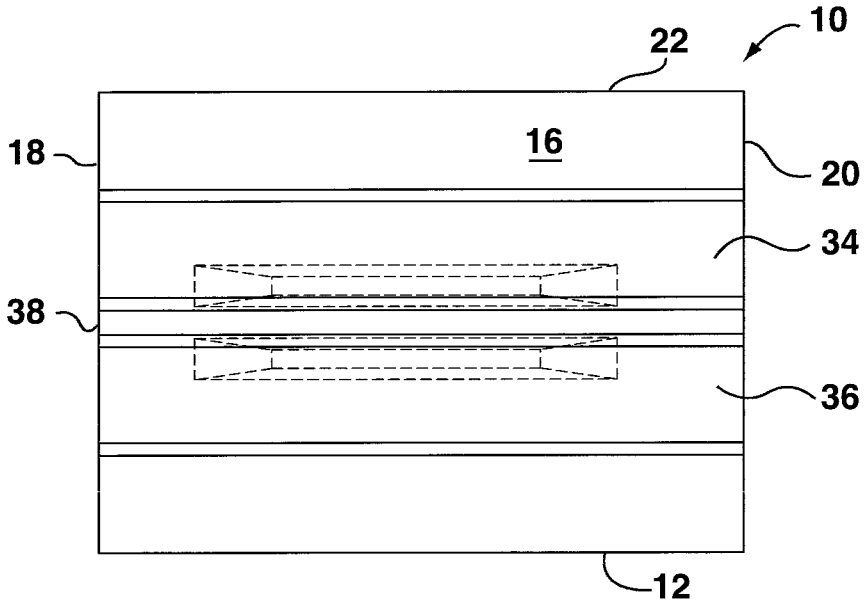
FIG. 6 is a bottom view of the block of FIG. 1.

FIGS. 4, 5 and 6 illustrate a respective top view, front view and bottom view of block 10 of FIG. 1. FIG. 4 illustrates block 10 having a length dimension 39.

Figure 7:
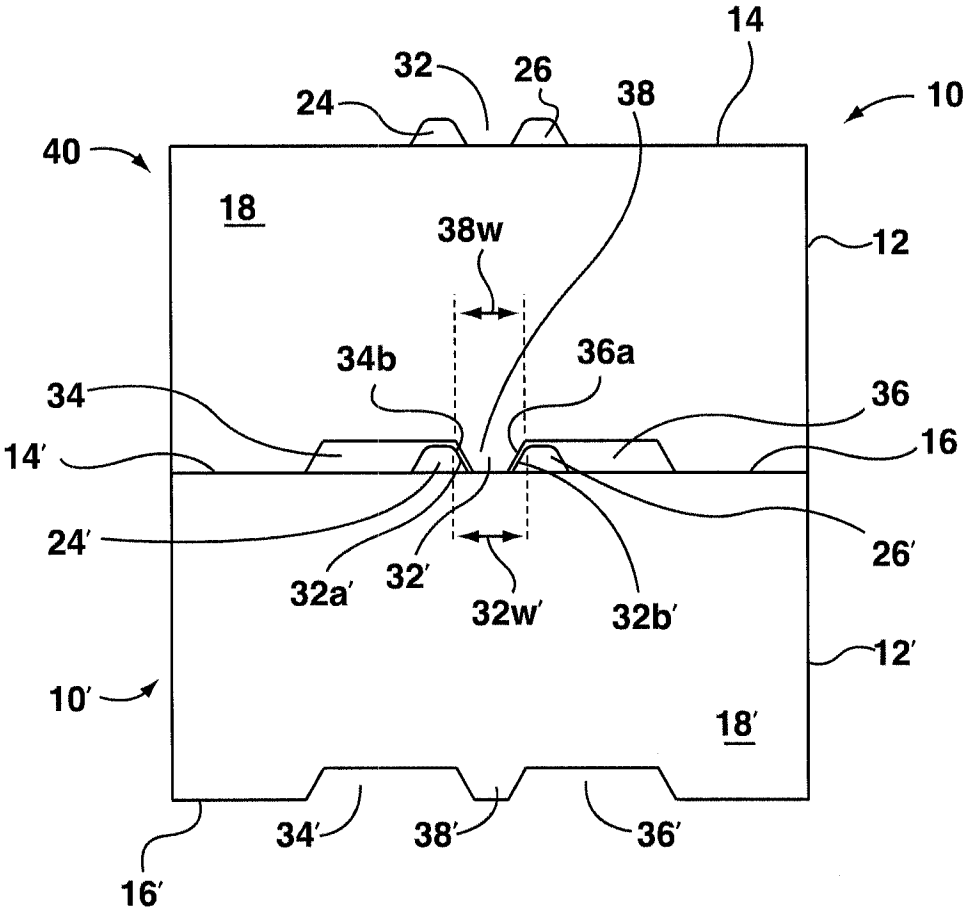
FIG. 7 is a side view of an exemplary retaining wall system comprising the block of FIG. 1 connected to another retaining wall block in an aligned position.
Figure 8:
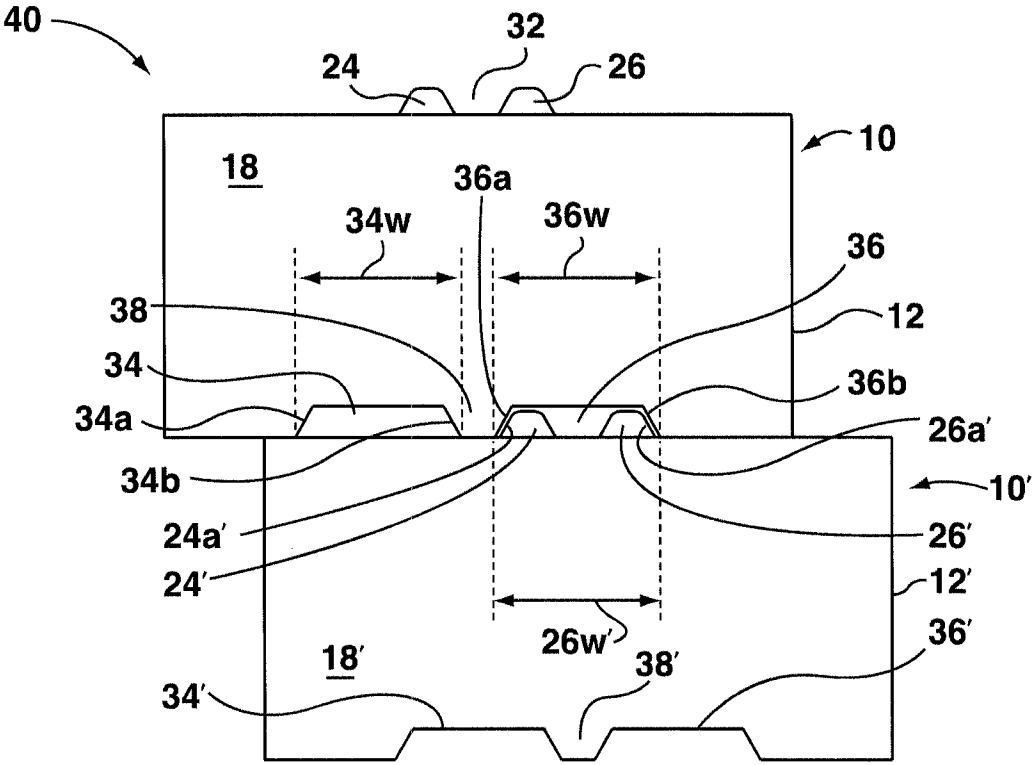
FIG. 8 is a side view of the retaining wall system of FIG. 7 wherein the blocks are connected in an offset position.
Figure 9:
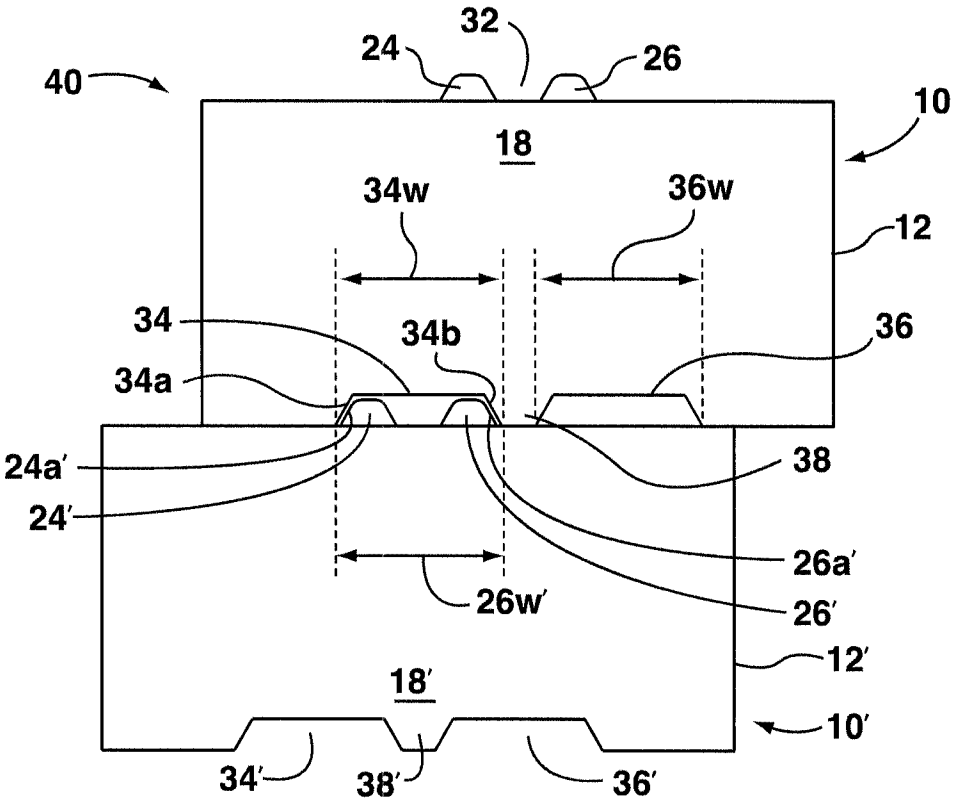
FIG. 9 is a side view of the retaining wall system of FIG. 8 wherein the blocks are connected in a different offset position.

As illustrated in FIGS. 7 to 9, block 10 is connectable to another retaining wall block 10' to form at least a portion of a retaining wall system 40. For clarity, the exemplary retaining wall systems illustrated in FIGS. 7 to 9 show only two blocks 10, 10'. Those skilled in the art will appreciate that, typically, more than two retaining wall blocks 10, 10' are connected together to form a retaining wall.

For simplicity and clarity of illustration, to indicate corresponding or analogous elements for blocks 10 and 10', the same reference numerals used for block 10 are used for block 10' (with the "prime" symbol added for block 10' and its elements). It will also be understood that block 10 represents a block also referred to as a first block, and that block 10' represents another block also referred to as a second block.

FIG. 7 shows (first) block 10 connected to another (second) block 10' in a first position where respective front faces 12 and 12' of blocks 10 and 10' are aligned. More specifically, the front faces are vertically aligned with each other.

The block 10 of retaining wall system 40 has elongate spaced apart bottom grooves 34, 36 in bottom surface 16. In the embodiments shown in FIG. 7, block 10 and block 10' both have elongate spaced apart bottom grooves 34, 36 and 34', 36' in their respective bottom surfaces 16, 16'.

The block 10' of retaining wall system 40 has the pair of elongate spaced apart top projections 24', 26' in top surface 14'. In the embodiments shown in FIG. 7, block 10 and block 10' both have elongate spaced apart top projections 24, 26 and 24', 26', in their respective top surfaces 14, 14'.

As shown in FIG. 7, in the first position, bottom protrusion 38 of block 10 is received within top groove 32' of block 10'. Each one of top projections 24', 26' is received within a corresponding different one of the bottom grooves 34, 36. Top projection 24' is received within bottom groove 34, and top projection 26' is received within bottom groove 36.

Bottom protrusion 38 may have a protrusion width 38*w* extending between respective side edges 34*b* and 36*a* of bottom grooves 34 and 36. Top groove 32' of block 10' has a top groove width 32*w'* extending between side edges 32*a'* and 32*b'*. To facilitate insertion of bottom protrusion 38 into top groove 32', protrusion width 38*w* is less than or equal to top groove width 32*w'*. Preferably, bottom protrusion 38 is received by friction fit into top groove 32'.

In some embodiments, the tapered side edges 34*b*, 36*a* that define bottom protrusion 38 mate with the tapered side edges 32*a'* and 32*b'* of top groove 32' to facilitate insertion of the tapered bottom protrusion 38 therein.

Referring to FIG. 8 as an example, block 10 is connectable to block 10' in a second position 10 where respective front faces 12 and 12' are offset. More specifically, the front faces are vertically offset from each other. In the offset position shown in FIG. 8, the pair of top projections 24', 26' of block 10' are received within bottom groove 36 of block 10.

In the offset position shown in FIG. 8, each one of the pair of top projections 24', 26' of block 10' are preferably located proximate to a corresponding side edge 36*a*, 36*b* of one of the bottom groove 36 of block 10.

Referring to FIG. 9 as an example, block 10 may be connectable to block 10' in a third position where front face 12 of block 10 and front face 12' of block 10' are offset in a different, preferably opposite, orientation from the orientation shown in FIG. 8. More specifically, the front faces are vertically offset from each other. In the offset position of FIG. 9, the pair of top projections 24', 26' are received within bottom groove 34 of block 10. In the embodiment of FIG. 9, top projection 24' is located proximate to side edge 34*a*, while top projection 26' is located proximate to side edge 34*b* of bottom groove 34.

Although the positions illustrated in FIGS. 8 and 9 have been identified as the second and third positions, respectively, it should be understood that the position of FIG. 9 may be considered the second position and the position of FIG. 8 may be considered the third position.

Referring back to FIG. 8, each of the top projections 24', 26' of block 10' has a respective outer side edge 24*a'*, 26*a'*. The top projections have a top projection width 26*w'* extending between outer side edges 24*a'* and 26*a'*.

Continuing to refer to FIG. 8, bottom groove 34 has a groove width 34*w* extending between the pair of opposing side edges 34*a* and 34*b*. Bottom groove 36 has a groove width 36*w* extending between the pair of opposing side edges 36*a* and 36*b*.

To facilitate insertion of top projections 24', 26' into one of bottom groove 34 and 36, top projection width 26*w'* is preferably less than or equal to groove widths 34*w* and 36*w*. As shown in FIG. 8, groove width 34*w* may be substantially equal to groove width 36*w*. In that case, top projections 24', 26' are both insertable into ether of bottom groove 34 or 36. Preferably, top projections 24', 26' are secured by friction fit within bottom grooves 34 or 36 (depending on the desired offset orientation).

In some embodiments, the tapered outer edges 24*a'*, 26*a'* of top protrusions 24', 26' mate with at least one of the pair of tapered side edges 34*a*, 34*b* and tapered side edges 36*a*, 36*b* to facilitate insertion of the tapered top protrusions 24', 26' into one of grooves 34, 36.

For some embodiments, block 10 and block 10' are substantially identical. More specifically, for some embodiments, at least one set of: top projections 24, 26 and 24', 26' and bottom grooves 34, 36 and 34', 36' are identical for blocks 10 and 10', respectively.

Figure 10:
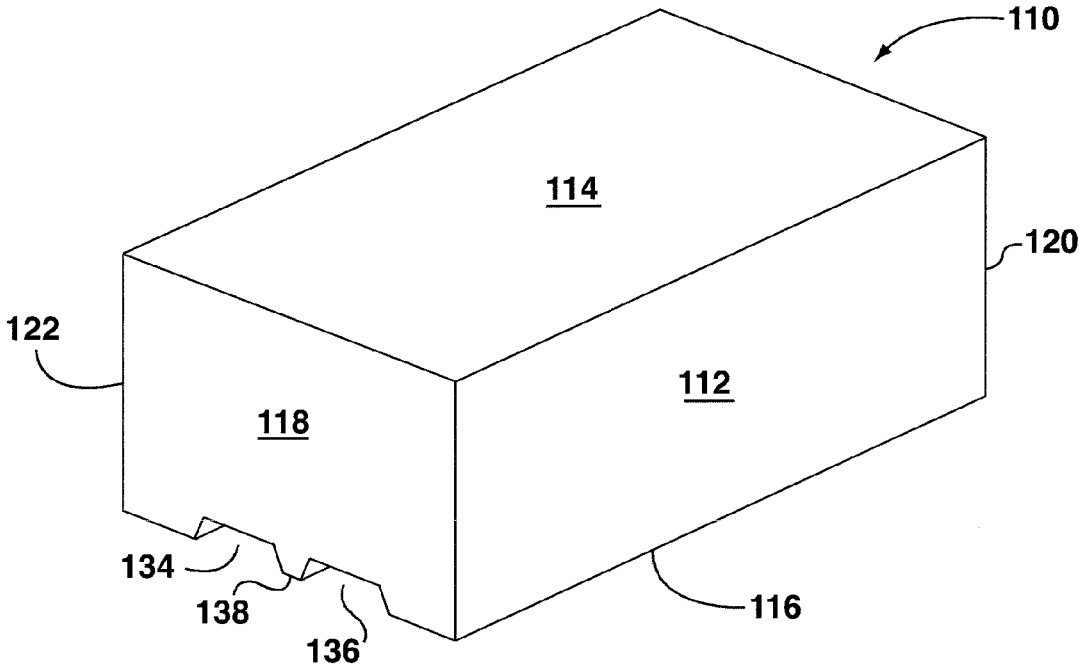
FIG. 10 is a perspective view of another exemplary retaining wall block.
Figure 11:
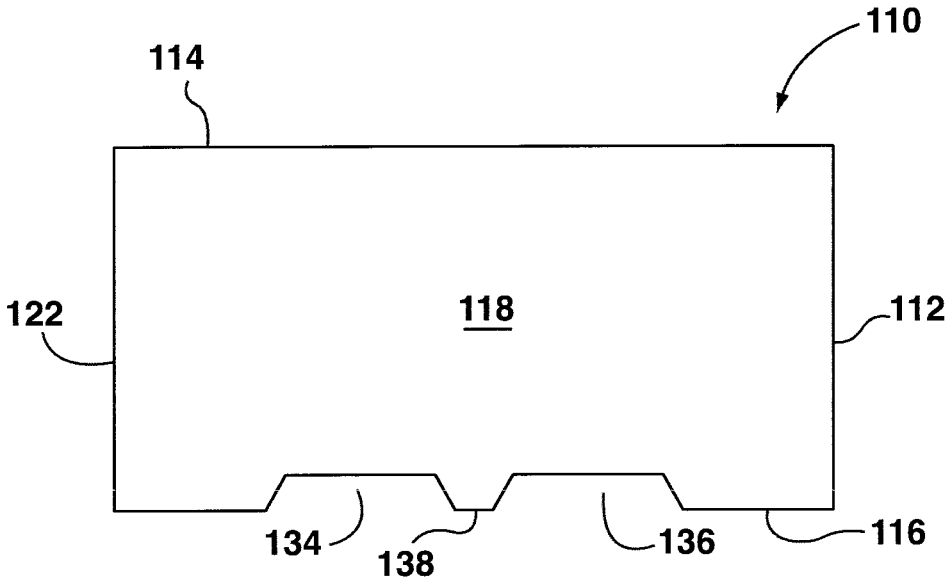
FIG. 11 is a side view of the block of FIG. 10.

FIGS. 10 and 11 illustrate another exemplary retaining wall block 110. The structure of block 110 is generally similar to the structure of block 10 shown in FIGS. 1-6. However, block 110 does not have top projections in top surface 114. Instead, top surface 114 is substantially planar. In some embodiments, as will be discussed in further detail below, block 110 is the highest block in a stack of blocks forming at least part of a retaining wall system. It will be appreciated that for simplicity and clarity of illustration, elements of block 110 corresponding or analogous to elements of block 10 are labeled with the same reference numerals as for block 10 (plus 100). For brevity, the description of corresponding or analogous elements is not repeated.

FIGS. 7, 8 and 9 illustrate a simplified view of a retaining wall system 40 having two blocks 10, 10'. FIGS. 12 to 15 illustrate a retaining wall system 42 having more than two blocks (i.e. combining blocks 10, 10', and 110). For a retaining wall system having more than two stacked blocks, the two blocks in each pair of mating blocks 10, 10' are stackable with one another in one of the configurations described for FIGS. 7, 8 and 9, above.

Figure 12:
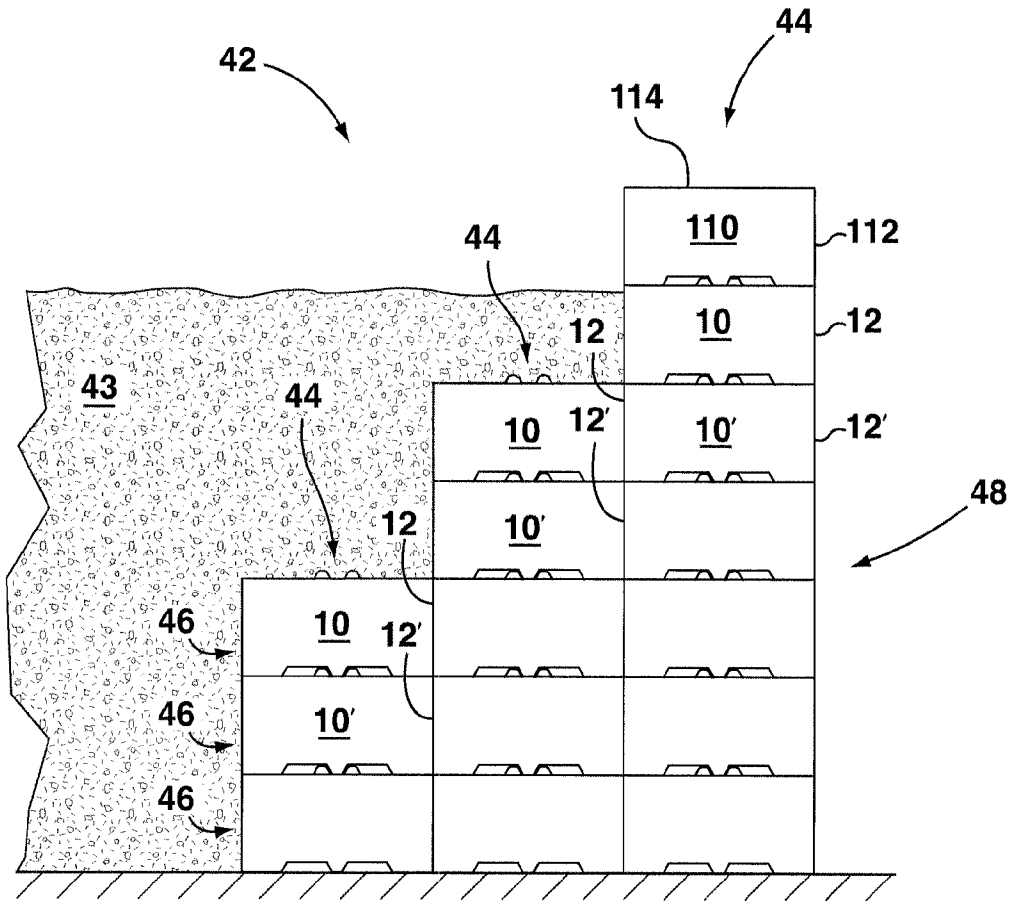
FIG. 12 is a side view of another exemplary retaining wall system wherein the retaining wall blocks are connected in the aligned position.
Figure 13:
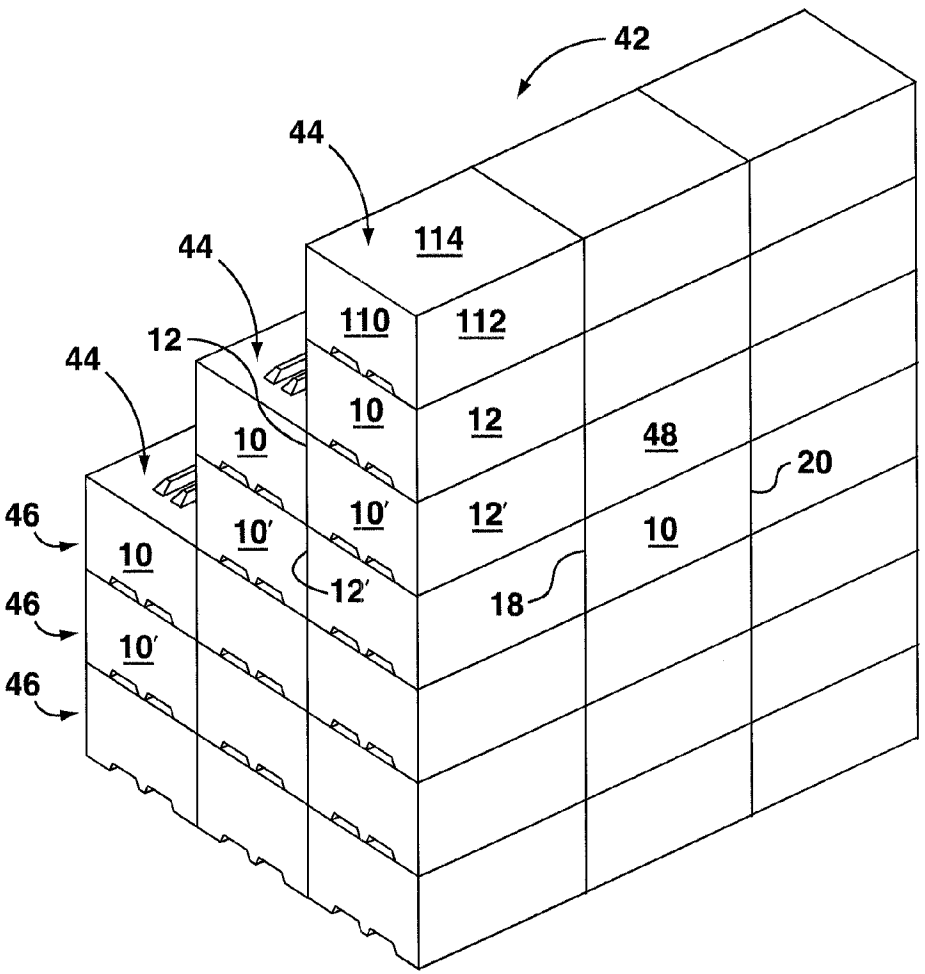
FIG. 13 is a perspective view of the retaining wall system configuration of FIG. 12.
Figure 14:
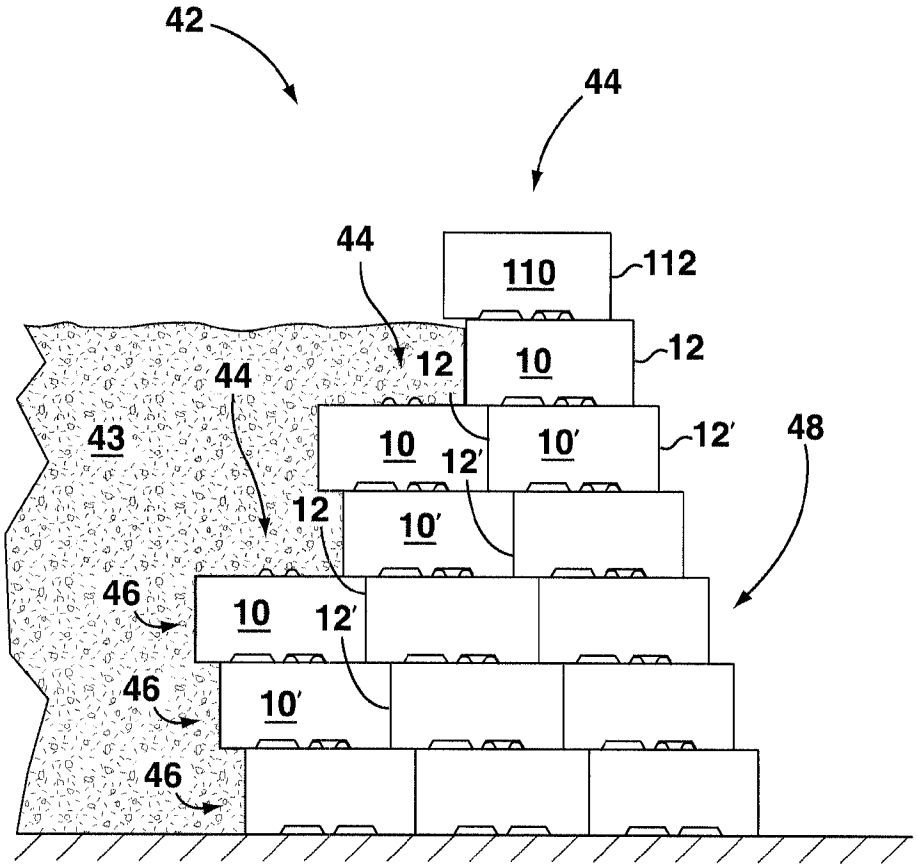
FIG. 14 is a side view of another exemplary retaining wall system wherein the blocks are connected in the offset position.

As illustrated in FIGS. 12 to 15, a plurality of blocks may be connectably stacked to form multiple columns and rows of blocks. Retaining wall system 42 shown in FIGS. 12 to 15 may be used to laterally support earth material 43, for example (as shown in FIGS. 12 and 14). The retaining wall system 42 has one or more columns 44 of blocks. FIGS. 12 and 14 exemplify retaining wall system 42 consisting of three columns 44. As exemplified, each column 44 includes a different number of rows 46 of connectably stacked blocks. In alternative embodiments, some or all of the columns may have the same number of rows 46.

FIG. 13 provides a perspective view of the retaining wall system configuration of FIG. 12 (the earth material not shown). As shown in FIG. 13, blocks 10, 10' may be vertically stacked and aligned side-to-side such that sidewalls 18 and 20 of adjacent blocks are in contact with one another. FIG. 13 shows block 10 having sidewalls 18, 20 in contact with the sidewalls of adjacent blocks to provide a front surface 48 for retaining wall system 42.

FIGS. 12 and 13 show a plurality of stacked blocks 10, 10' connected to one another in the first position so that the respective faces 12, 12' of blocks 10, 10' are aligned. More specifically, the front faces are all vertically aligned with one another. In this manner, a substantially planar front surface 48 of retaining wall system 42 (comprising front faces 12, 12') is provided.

As shown in FIGS. 12 and 13, the uppermost block of any column may be block 10 (see FIG. 1) or block 110 (see FIG. 10). Block 110 may be placed on the top of a column 44 of stacked blocks 10, 10' to provide an aesthetically pleasing planar top surface 114. It will be appreciated that top projections 24, 26 are not necessarily required on the uppermost blocks. In some embodiments (not shown), the lowermost block of a column may have a planar bottom surface 16 instead of having lower grooves 34, 36 and bottom protrusion 38.

Figure 15:
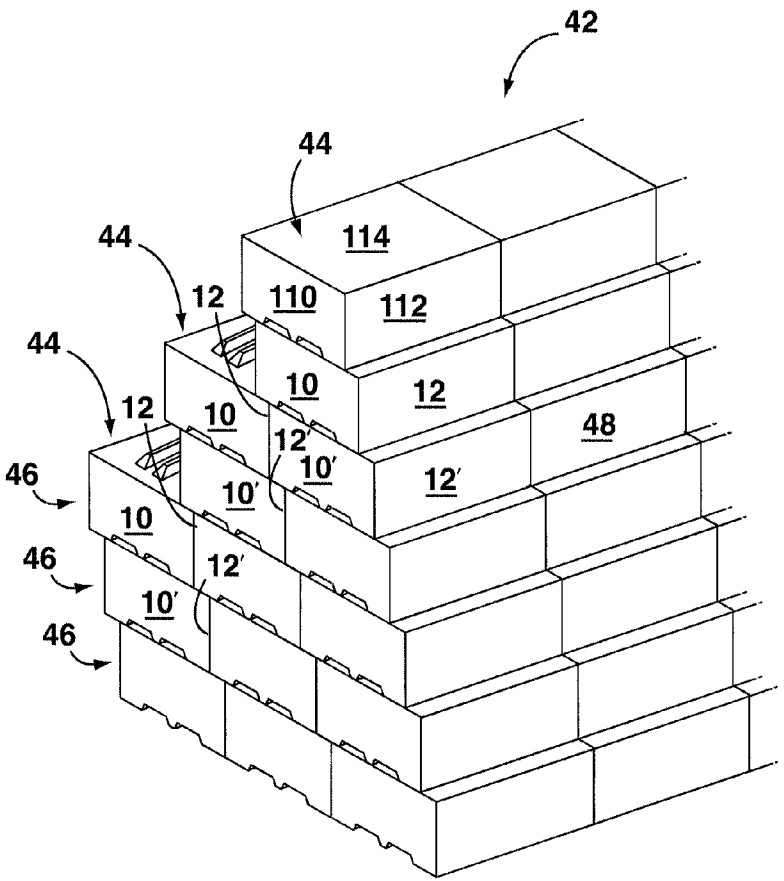
FIG. 15 is a perspective view of the retaining wall system configuration of FIG. 14.

An alternative configuration for the retaining wall system of FIGS. 12 and 13 is shown in FIGS. 14 and 15. In the configuration shown in FIGS. 14 and 15, blocks 10 and 10' are connectably stacked to one another in the offset position discussed above for FIG. 8. The plurality of stacked blocks 10, 10' are connected to one another so that the respective faces 12, 12' of block 10, 10' are offset from one another. In this manner, a vertically staggered (or "stepped") front face 48 of retaining wall 42 (comprising front faces 12, 12') is provided.

It will be appreciated that in an alternative configuration for the retaining wall system, at least one pair of blocks 10, 10' are stacked in the different offset position illustrated in FIG. 9.

Referring to FIGS. 12-15, in some embodiments, the retaining wall blocks 10 and 10' may be substantially identical. In other embodiments, the retaining wall blocks 10 and 10' may have physical dimensions that vary from each other so long as the blocks are connectably stackable in at least the aligned position (see FIG. 12) and the offset position (see FIG. 14). Preferably, blocks 10, 10' are also stackable in the different offset position (see FIG. 9).

FIGS. 12-15 exemplify retaining wall system 42 configurations where all of block 10 and 10' are either in the aligned (FIG. 12) or offset (FIG. 14) positions. Alternatively, retaining wall system 42 may be configured so that different pairs of blocks 10, 10' are stacked in different positions. In some embodiments, different blocks 10, 10' within a retaining wall system may be stacked in any one of the aligned (see FIG. 7), or offset (see FIGS. 8 and 9) positions. In some cases, one or more pairs of front faces 12, 12' are vertically aligned, while one of more pairs of font faces 12, 12' are vertically offset.

A further embodiment relates to a method of constructing a retaining wall. The (first) block 10 and the other (second) block 10', as discussed above, are used to construct a retaining wall according to the method that will now be discussed. For brevity, the description of previously elements and figures is not repeated.

The method comprises connectably stacking (first) block 10 with another (second) block 10' in one of a first position and a second position. In the first position exemplified in FIG. 7, the front faces 12, 12' of block 10 and block 10' are aligned. In the second position exemplified in FIG. 8 or 9, front faces 12, 12' of the first and second block are offset.

As shown in FIG. 7, in the first position, bottom protrusion 38 of block 10 is received within top groove 32' of block 10'.

As exemplified in FIG. 8, in the second position, the pair of top projections 24', 26' of block 10' are received within one of the pair of bottom grooves 34, 36 of block 10.

Figure 16:
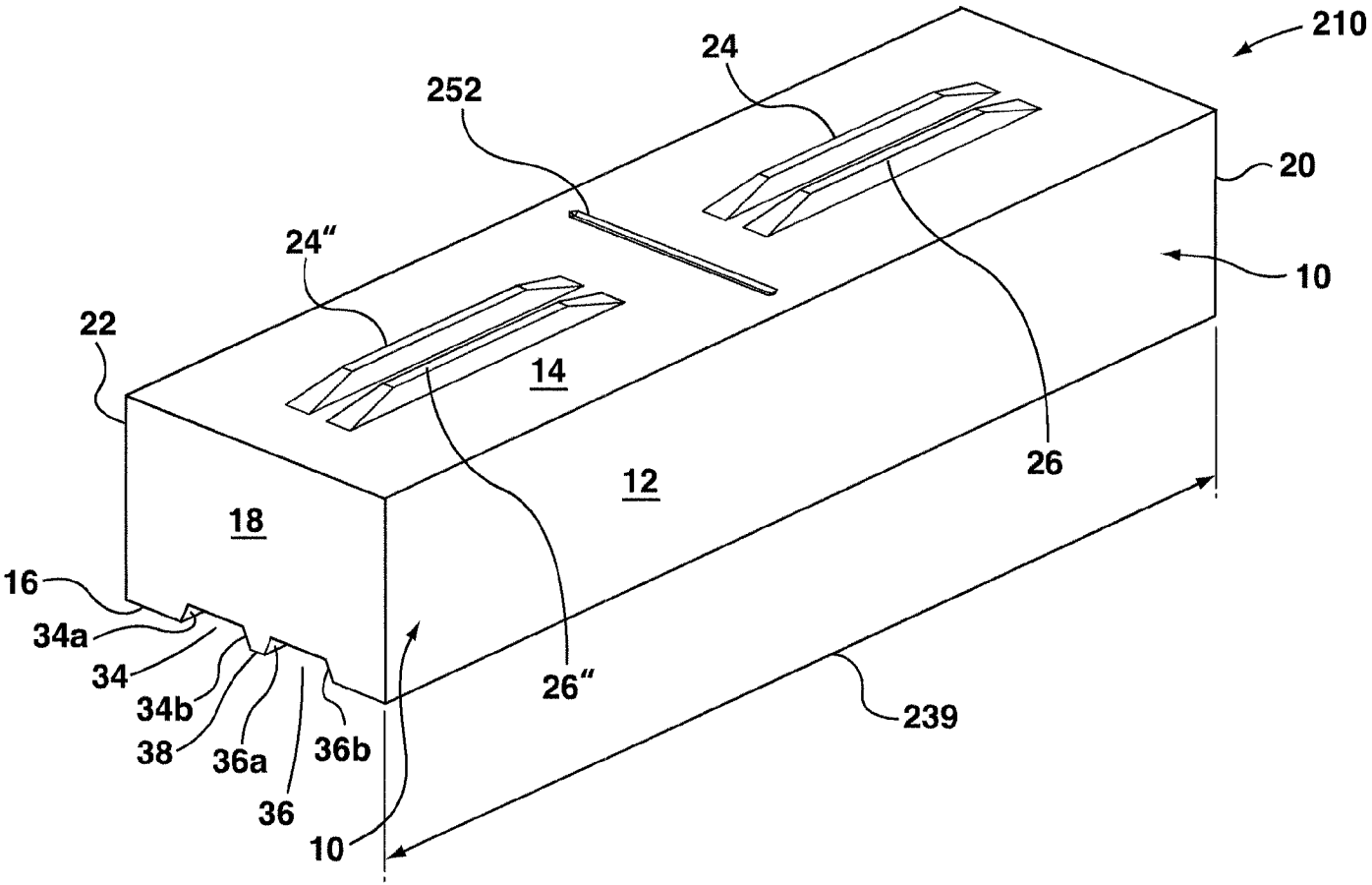
FIG. 16 is a perspective view of yet another exemplary retaining wall block.
Figure 17:
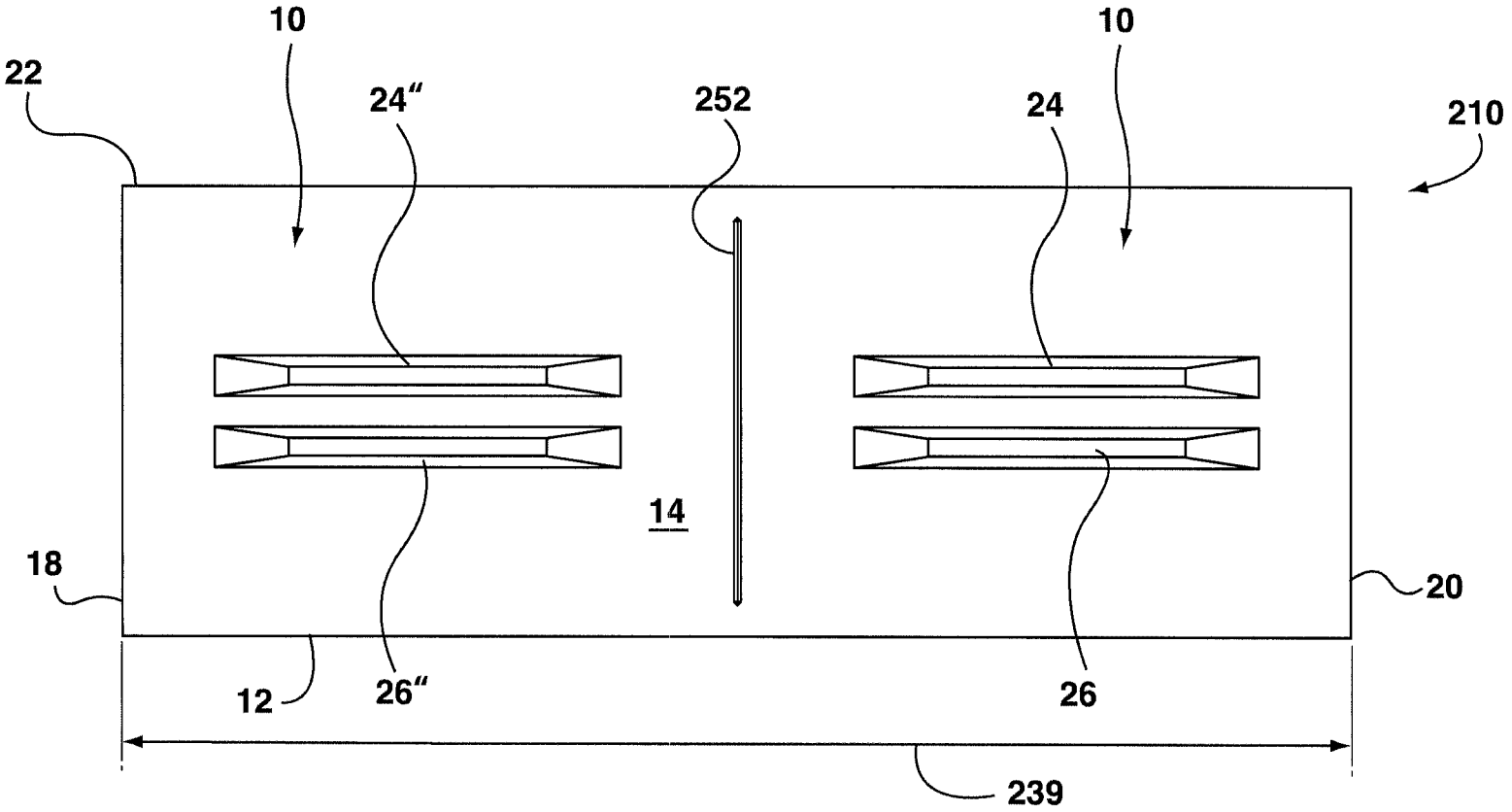
FIG. 17 is a top view of the retaining wall block of FIG. 16.

FIGS. 16 and 17 illustrate an exemplary block 210 according to an alternative embodiment. Block 210 is comprised of two blocks 10, as described above, integrally formed and longitudinally aligned with one another. A splitting line 252 may be located at the interface of the two blocks 10. Because block 210 is comprised of two blocks 10, it has a first pair of elongate spaced apart top projections 24, 26, and a second pair of elongate spaced apart top projections 24", 26" extending along top surface 14. The first and second pairs of top projections are preferably identical to the top projections 24, 26 of block 10 described above. In some cases, block 210 has a length dimension 239 (see FIG. 16) that is larger than the length dimension 39 of block 10 (see FIG. 4), to accommodate the two pairs of top projections. More preferably, the length dimension 239 is double the length dimension 39. It will be appreciated that for simplicity and clarity of illustration, elements of block 210 corresponding or analogous to elements of block 10 are labeled with the same reference numerals as for block 10. For brevity, the description of corresponding or analogous elements is not repeated.

As shown in FIG. 16, the first pair of top projections 24, 26 and the second pair of top projections 24", 26" extend along top surface 14. The first pair of top projections 24, 26 are spaced apart longitudinally from the second pair of top projections 24", 26", along top surface 14. Each top projection of the first pair of top projections 24, 26 is longitudinally aligned with a corresponding top projection of the second pair of top projections 24", 26".

The pair of bottom grooves 34, 36 and the bottom protrusion 38 may be coextensive along bottom surface 16 of block 210. The bottom grooves 34, 36 and bottom protrusion 38 may extend entirely along bottom surface 16 between sidewalls 18 and 20 of block 210.

As illustrated in FIG. 16, block 10 may have a splitting line 252 located between the first pair of top projections 24, 26 and the second pair of top projections 24", 26". Splitting line 252 may extend transversely between front face 12 and rear face 22. Splitting line 252 may be a groove formed in top surface 14 (as shown) or may be marked onto top surface 14 (not shown). A splitting tool may be used to severe block 210 along splitting line 252, to separate block 210 into two equal halves (i.e. two equal blocks 10). In use, the halves of block 210 may be installed into a retaining wall in the same manner as outlined above for blocks 10, 10'.

Conversely, block 210 having the first pair of top projections 24, 26 and second pair of top projections 24", 26" may be installed into a retaining wall as a single unit. In this case, block 210 is installed into a retaining wall in the same manner as outlined above, with each top projection of the first pair of top projections 24, 26 and the second pair of top projections 24", 26" being received into a corresponding one of bottom grooves 34, 36 of at least one other block.

While the present invention as herein shown and described in detail is fully capable of attaining the above-described objects of the invention, it is to be understood that it is the presently preferred embodiments of the present invention and thus, is representative of the subject matter which is broadly contemplated by the present invention, that the scope of the present invention fully encompasses other embodiments which may become obvious to those skilled in the art, and that the scope of the claims should not be limited by the preferred embodiments set forth in the examples, but should be given the broadest interpretation consistent with the description as a whole. Moreover, it is not necessary for a device or method to address each and every problem sought to be solved by the present invention, for it is to be encompassed by the present claims.

The invention claimed is:

1. A retaining wall block connectable to another retaining wall block, the retaining wall block comprising:

a front face, a top surface and a bottom surface, a pair of sidewalls extending rearwardly from the front face, between the top and the bottom surfaces, a pair of elongate spaced apart bottom grooves in the bottom surface, wherein the pair of bottom grooves are oriented transversely to the pair of sidewalls, wherein the pair of bottom grooves define an elongate bottom protrusion therebetween, wherein each one of the pair of bottom grooves has a pair of opposing side edges and a groove width extending between the side edges, and wherein the groove width of a first of the pair of bottom grooves is substantially equal to the groove width of a second of the pair of bottom grooves; and a pair of elongate spaced apart top projections in the top surface, wherein the pair of top projections are oriented transversely to the pair of sidewalls, wherein the pair of top projections define an elongate top groove extending therebetween;

wherein the block is connectable to the other block in one of a first position where the front faces of the block and the other block are aligned, and a second position where the front faces of the block and the other block are offset, wherein, in the first position, the bottom protrusion of the block is received within the top groove of the other block, and wherein, in the second position, the pair of top projections of the other block are received within one of the pair of bottom grooves of the block.

2. The retaining wall block of claim 1 wherein, in the first position, each one of the pair of top projections of the other block is received within a corresponding different one of the pair of bottom grooves of the block.

3. The retaining wall block of claim 2 wherein, in the second position, each one of the pair of top projections of the other block is located proximate to a corresponding side edge of one of the pair of bottom grooves of the block.

4. The retaining wall block of claim 1 wherein the block is connectable to the other block in a third position where the front faces of the block and the other block are offset in a different orientation, and in the third position, the pair of top projections of the other block are received within the other one of the pair of bottom grooves of the block.

5. The retaining wall block of claim 1 wherein the block and the other block are substantially identical.

6. The retaining wall block of claim 1 wherein each end of the pair of top projections is located inwardly from the sidewalls, and the pair of bottom grooves extend entirely along the bottom surface between the sidewalls.

7. The retaining wall block of claim 1 wherein the top groove has a pair of side edges, wherein the pair of side edges of the top groove taper upwardly away from one another, and the bottom protrusion has a pair of side edges, wherein the pair of side edges of the bottom protrusion taper downwardly toward one another.

8. The retaining wall block of claim 7 wherein the pair of top projections comprise a pair of outer side edges, wherein the outer side edges of the pair of top projections taper upwardly toward one another, and at least one of the pair of bottom grooves has a pair of side edges that taper downwardly away from one another.

9. The retaining wall block of claim 8 wherein the pair of top projections extend in parallel orientation to one another along the top surface.

10. The retaining wall block of claim 9 wherein the pair of bottom grooves extend in parallel orientation to one another along the bottom surface.

11. The retaining wall block of claim 1 further comprising a second pair of elongate spaced apart top projections extending along the top surface, wherein each top projection of the pair of top projections is longitudinally aligned with a corresponding top projection of the second pair of top projections.

12. A retaining wall system comprising:

at least a first block and a second block, the first block and the second block each comprising:

a front face, a top surface and a bottom surface, a pair of sidewalls extending rearwardly from the front face, between the top and the bottom surfaces, and at least the first block having a pair of elongate spaced apart bottom grooves in the bottom surface, wherein the pair of bottom grooves are oriented transversely to the pair of sidewalls, wherein the pair of bottom grooves define an elongate bottom protrusion therebetween, wherein each one of the pair of bottom grooves has a pair of opposing side edges and a groove width extending between the side edges, and wherein the groove width of a first of the pair of bottom grooves is substantially equal to the groove width of a second of the pair of bottom grooves; and at least the second block having a pair of elongate spaced apart top projections in the top surface, wherein the pair of top projections are oriented transversely to the pair of sidewalls, wherein the pair of top projections define an elongate top groove extending therebetween;

wherein the first and second block are connectable in one of a first position where the front faces of the first and second block are aligned, and a second position where the front faces of the first and second block are offset, wherein, in the first position, the bottom protrusion of the first block is received within the top groove of the second block, and wherein, in the second position, the pair of top projections of the second block are received within one of the pair of bottom grooves of the first block.

13. The retaining wall system of claim 12 wherein, in the first position, each one of the pair of top projections of the second block is received within a corresponding different one of the pair of bottom grooves of the first block.

14. The retaining wall system of claim 13 wherein, in the second position, each one of the pair of top projections of the second block is located proximate to a corresponding side edge of one of the pair of bottom grooves of the first block.

15. The retaining wall system of claim 12 wherein the second block is connectable to the first block in a third position where the front faces of the first block and the second block are offset in a different orientation, wherein in the third position, the pair of top projections of the second block are received within the other one of the pair of bottom grooves of the first block.

16. The retaining wall system of claim 12 wherein the first block has the pair of elongate spaced apart top projections in the top surface.

17. The retaining wall system of claim 12 wherein the top surface of the first block is substantially planar.

18. The retaining wall system of claim 12 wherein the second block has the pair of elongate spaced apart bottom grooves in the bottom surface.

19. A method of constructing a retaining wall comprising:

connectably stacking a first block with a second block in one of a first position where the front faces of the first and second block are aligned, and a second position where the front faces of the first and second block are offset;

wherein the first block and second block each comprise:

a front face, a top surface and a bottom surface, a pair of sidewalls extending rearwardly from the front face, between the top and bottom surfaces, at least the first block having a pair of elongate spaced apart bottom grooves in the bottom surface, wherein the pair of bottom grooves are oriented transversely to the pair of sidewalls, wherein the pair of bottom grooves define an elongate bottom protrusion therebetween, wherein each one of the pair of bottom grooves has a pair of opposing side edges and a groove width extending between the side edges, and wherein the groove width of a first of the pair of bottom grooves is substantially equal to the groove width of a second of the pair of bottom grooves, and at least the second block having a pair of elongate spaced apart top projections in the top surface, wherein the pair of top projections are oriented transversely to the pair of sidewalls, wherein the pair of top projections define an elongate top groove extending therebetween, wherein, in the first position, a bottom protrusion of the first block is received within the top groove of the second block, and wherein, in the second position, the pair of top projections of the second block are received within one of the pair of bottom grooves of the first block.

20. A retaining wall block connectable to another retaining wall block, the retaining wall block comprising:

a front face, a top surface and a bottom surface, a pair of sidewalls extending rearwardly from the front face, between the top and the bottom surfaces, a pair of elongate spaced apart bottom grooves in the bottom surface, wherein the pair of bottom grooves are oriented transversely to the pair of sidewalls, wherein the pair of bottom grooves define an elongate bottom protrusion therebetween; and a pair of elongate spaced apart top projections in the top surface, wherein the pair of top projections are oriented transversely to the pair of sidewalls, wherein the pair of top projections define an elongate top groove extending therebetween;

wherein the block is connectable to the other block in one of a first position where the front faces of the block and the other block are aligned, a second position where the front faces of the block and the other block are offset, and a third position where the front faces of the block and the other block are offset in a different orientation, wherein, in the first position, the bottom protrusion of the block is received within the top groove of the other block, wherein, in the second position, the pair of top projections of the other block are received within one of the pair of bottom grooves of the block, and wherein, in the third position, the pair of top projections of the other block are received within the other one of the pair of bottom grooves of the block.

* * * * *